US006224433B1

(12) United States Patent
Chadbourne et al.

(10) Patent No.: US 6,224,433 B1
(45) Date of Patent: May 1, 2001

(54) ELECTRICAL CONNECTOR FOR CROSSING REINFORCING BARS

(75) Inventors: Richard Chadbourne, Merrimack; Neil S Dunn, Londonderry, both of NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/421,977

(22) Filed: Oct. 20, 1999

(51) Int. Cl.[7] ..... H01R 4/10
(52) U.S. Cl. ..... 439/877; 174/71 R
(58) Field of Search ..... D13/173; 174/71 R, 174/94 R; 439/877, 880, 881, 776

(56) References Cited

U.S. PATENT DOCUMENTS

| | | | | |
|---|---|---|---|---|
| 371,808 | * | 10/1887 | Waring | 174/71 R |
| 416,289 | | 12/1889 | Ellinwood . | |
| 683,672 | | 10/1901 | Wellman . | |
| 1,070,948 | * | 8/1913 | Dodd | 174/71 R |
| 2,307,216 | | 1/1943 | Graham | 173/273 |
| 2,760,798 | | 8/1956 | Evans | 287/49 |
| 3,183,025 | | 5/1965 | Lynch, Jr. et al. | 287/78 |
| 3,185,762 | * | 5/1965 | Shaw | 174/71 R |
| 3,255,565 | | 6/1966 | Menzel | 52/678 |
| 3,290,746 | * | 12/1966 | Broske | 439/863 |
| 3,297,817 | * | 1/1967 | Stier | 174/71 R |
| 3,422,391 | * | 1/1969 | Thomson | 174/71 R |
| 4,302,124 | | 11/1981 | Wilks et al. | 403/391 |
| 4,405,827 | | 9/1983 | Mixon, Jr. | 174/94 R |
| 4,942,757 | | 7/1990 | Pecora | 72/453 |
| 4,976,627 | * | 12/1990 | O'Loughlin | 439/880 |
| 5,062,290 | | 11/1991 | Hoover | 72/416 |

FOREIGN PATENT DOCUMENTS 251253 12/1966 (DE) .

OTHER PUBLICATIONS

Product Catalog "Compression, Type YC–L Thin–Wall Copper C–Tap UL Listed To 600 Volts", Framatome Connectors/ Burndy Electrical, 2 pages.

* cited by examiner

*Primary Examiner*—Paula Bradley
*Assistant Examiner*—Tho D. Ta
(74) *Attorney, Agent, or Firm*—Perman & Green, LLP

(57) ABSTRACT

An electrical connector for connecting first and second conductive crossing bars together comprising a first elongated enclosure for at least partially enclosing the first bar; and a second elongated enclosure intersecting said first elongated enclosure for at least partially enclosing the second bar. The first and second enclosures are comprised of a single sheet metal member. The first elongated enclosure may be crimped on the first bar and the second elongated enclosure may be separately crimped on the second bar.

12 Claims, 2 Drawing Sheets

ELECTRICAL CONNECTOR FOR CROSSING REINFORCING BARS

BACKGROUND OF THE INVENTION

1. Field of the Invention

The present invention relates to electrical connectors and, more particularly, to a connector for reinforcing bars which are crossing each other.

2. Prior Art

U.S. Pat. No. 2,760,798 discloses an electrical tap connector formed from a blank of sheet metal. The connector is for connecting two crossing conductors. The connector is compressed onto the two conductors simultaneously. In the prior art, crossing reinforcing bars, such as used in steel reinforced concrete, were electrically connected to each other by arc welding the two bars to each other for electrical bonding. It is desired to eliminate the need for welding reinforcing bars to each other.

SUMMARY OF THE INVENTION

In accordance with one embodiment of the present invention, an electrical connector is provided for connecting first and second conductive crossing bars together comprising a first elongated enclosure for at least partially enclosing the first bar; and a second elongated enclosure intersecting said first elongated enclosure for at least partially enclosing the second bar. The first and second enclosures are comprised of a single sheet metal member. The first elongated enclosure may be crimped on the first bar and the second elongated enclosure may be separately crimped on the second bar.

In accordance with another embodiment of the present invention, an electrical connector is provided comprising a first section having a first receiving area which is sized and shaped to receive a portion of a first elongate bar therein; and a second section having a second receiving area which is sized and shaped to receive a portion of a second elongate bar therein. The first and second sections are comprised of a single sheet metal member. The first and second receiving areas are angled relative to each other. The receiving areas are connected to each other at an intersection of the receiving areas such that the first and second bars contact each other when located in the receiving areas.

In accordance with one method of the present invention, a method of connecting two bars with an electrical connector is provided comprising steps of providing the electrical connector with two bar receiving areas located at angles relative to each other, the connector comprising a formed sheet metal member; locating the electrical connector on the two bars, the two bars being angled relative to each other; and compressing the electrical connector onto the bars by compressing a first section of the connector onto a first one of the bars and subsequently compressing a second separate section of the connector onto a second one of the bar.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
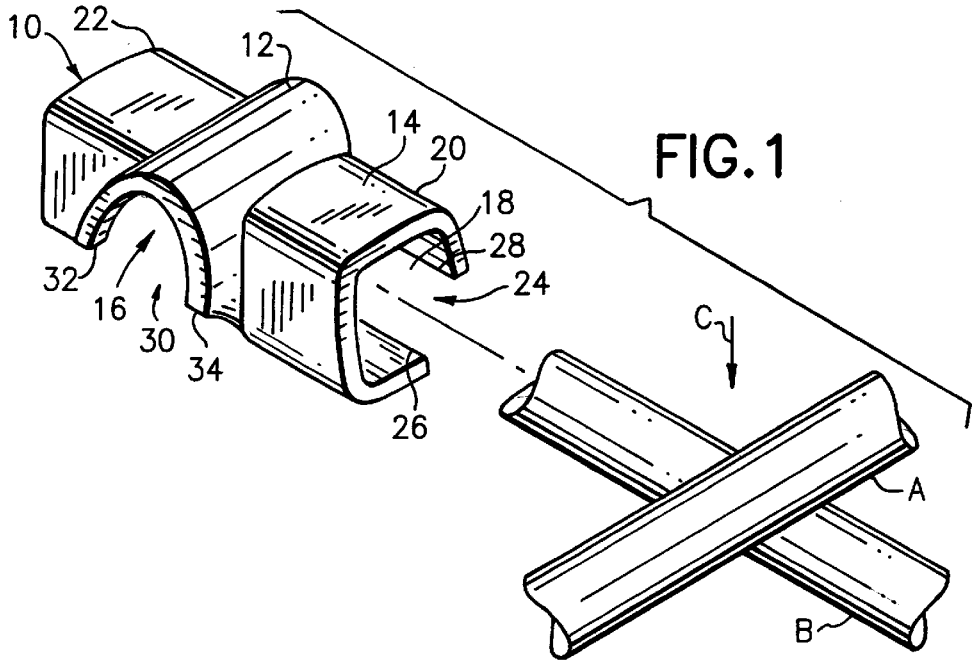
FIG. 1 is an exploded perspective view of two crossing bars and an electrical connector incorporating features of the present invention.

Referring to FIG. 1, there is shown an exploded perspective view of an electrical connector 10 incorporating features of the present invention and two crossing bars A, B intended to be connected by the connector. Although the present invention will be described with reference to the embodiments shown in the drawings, it should be understood that the present invention can be embodied in many alternate forms of embodiments. In addition, any suitable size, shape or type of elements or materials could be used.

The connector 10 is preferably a one-piece member comprised of stamped sheet metal. However, in alternate embodiments, the connector could be comprised of multiple members. Any suitable material other than sheet metal could also be used. Any suitable method(s) could be used to form the connector other than or in addition to stamping. The bars A, B are preferably steel reinforcing ars, such as those used in steel reinforced concrete construction. However, the connector 10 could be used to electrically connect any suitable crossing elongate members, such as connecting crossing electrical ground cables to each other or connecting a ground cable to a crossing reinforcing bar.

The connector 10 generally comprises a first section 12 and a second section 14. The first section 12 forms a first generally elongate enclosure with a first receiving area 16. The second section 14 forms a second generally elongate enclosure with a second receiving area 18. The first receiving area 16 is suitably sized and shaped to receive a portion of the first bar A therein. The second receiving area 18 is suitably sized and shaped to receive a portion of the second bar B therein. The two receiving areas 16, 18 are generally perpendicular to each other, slightly offset vertically from each other, but intersect or are adjacent to each other. In alternate embodiments any suitable angle other than 90° could be provided between the receiving areas 16, 18. In addition, the receiving areas need not be adjacent or intersect each other.

In this embodiment the second section 14 generally comprises two portions 20, 22. Each portion 20, 22 is located on opposite sides of the first section 12. The two portions 20, 22 are substantially mirror images of each other. However, in alternate embodiments the portions could have different sizes or shapes. In addition, the second section could be comprised of more or less than two portions. In this embodiment each portion 20, 22 has a general cross-sectional "C" shape. However, any suitable cross-sectional shape(s) could be provided. In this embodiment the cross-sectional "C" shape provides an entrance 24 into the receiving area 18 between the two elongate ends 26, 28 at a bottom side of the connector 10. In an alternate embodiment the entrance or entrances into the second receiving area 18 could be provided on any suitable side(s). The entrance 24 is preferably larger than the diameter of the bar B such that the connector can be slipped onto the bar B via the entrance 24. However, in alternate embodiments the entrance 24 need not be provided, such as when the connector is longitudinally slid onto the bar B. Alternatively, the entrance 24 could be slightly smaller than the diameter of the bar B such that the connector 10 is snapped onto the bar B with the ends 26, 28 resiliently moving as the bar B passes through the entrance 24. Thus, the connector 10 can be retained with the bar B as a loose pre-connection retainment before final connection of the connector to the bar B.

The first section 12 has an entrance 30 between two ends 32, 34 at the bottom side of the connector 10. However, the entrance could be provided on any suitable side. The entrance 30 is preferably larger than the diameter of the bar A such that the connector 10 can be slipped onto the bar A via the entrance 30. In an alternate embodiment the width of the entrance 30 could be slightly smaller than the diameter of the bar A such that the bar A must be snapped through the entrance 30. The ends 32, 34 can then prevent the bar A from inadvertently exiting the connector through the entrance 30; forming a loose pre-connection retainment before final connection of the connector to the bar A. In this embodiment the two entrances 24, 30 intersect each other at the bottom side of the connector. Thus, when both bars A, B are being located into their respective receiving areas 16, 18 via the entrances 30, 24, the first bar A must first be positioned in its receiving area 16 before the second bar B is positioned in its receiving area. Otherwise, the second bar B would block the entrance 30 to prevent the first bar A from entering the first receiving area 16 through the entrance 30. The first section 12 has a general elongate shape extending outward from opposite sides of the second section. Thus, the connector forms a general "X" shaped profile. In an alternate embodiment, the first section 12 need not extend outward from both opposite lateral sides of the second section. One or both of the opposite ends of the first section 12 could be flush with the lateral sides of the second section or could be recessed inward from the lateral sides of the second section.

With the two bars A, B crossing each other as shown in FIG. 1, the connector 10 can merely be placed onto the two bars in direction C onto the bars' intersection or crossing. With this embodiment the first bar A is captured between the top of the first section 12 and the top of the second bar B. Therefore, the first section 12 does not need to be crimped onto the first bar A. Instead, only the second section 14 is crimped. More specifically, the two portions 20, 22 are separately crimped onto the second bar B on opposite lateral sides of the first bar A. A suitable type of crimping or compression tool could be used, such as disclosed in U.S. Pat. Nos. 5,062,290 and 4,942,757 which are hereby incorporated by reference in their entireties. In an alternate embodiment the first section 12 could also be crimped onto the first bar A. When the two portions 20, 22 are crimped onto the second bar B, the top of the first section 12 compresses the first bar A against the second bar B. This forms a stationary fixed mechanical connection of the two bars A, B by the connector 10. Contact directly between the two bars A, B at their intersection and by the connector 10 on the two bars forms an electrical connection between the two bars.

Figure 2:
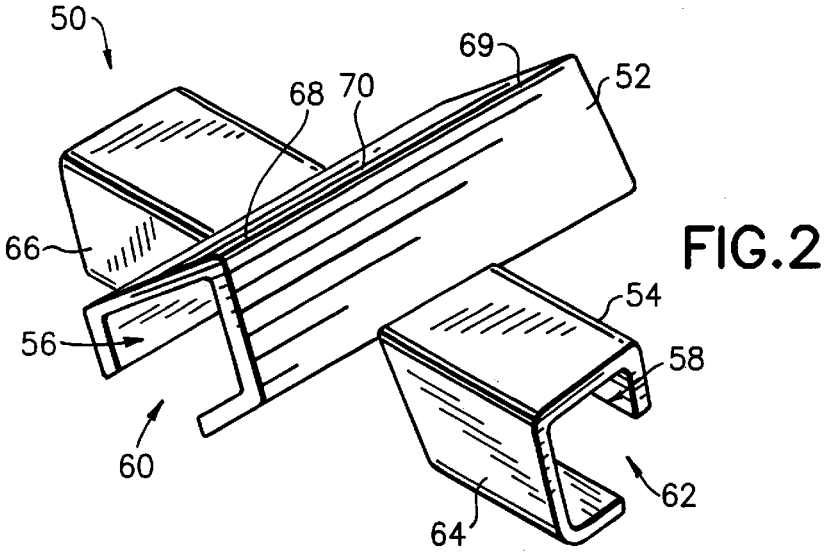
FIG. 2 is a perspective view of an alternate embodiment of the present invention.
Figure 2A:
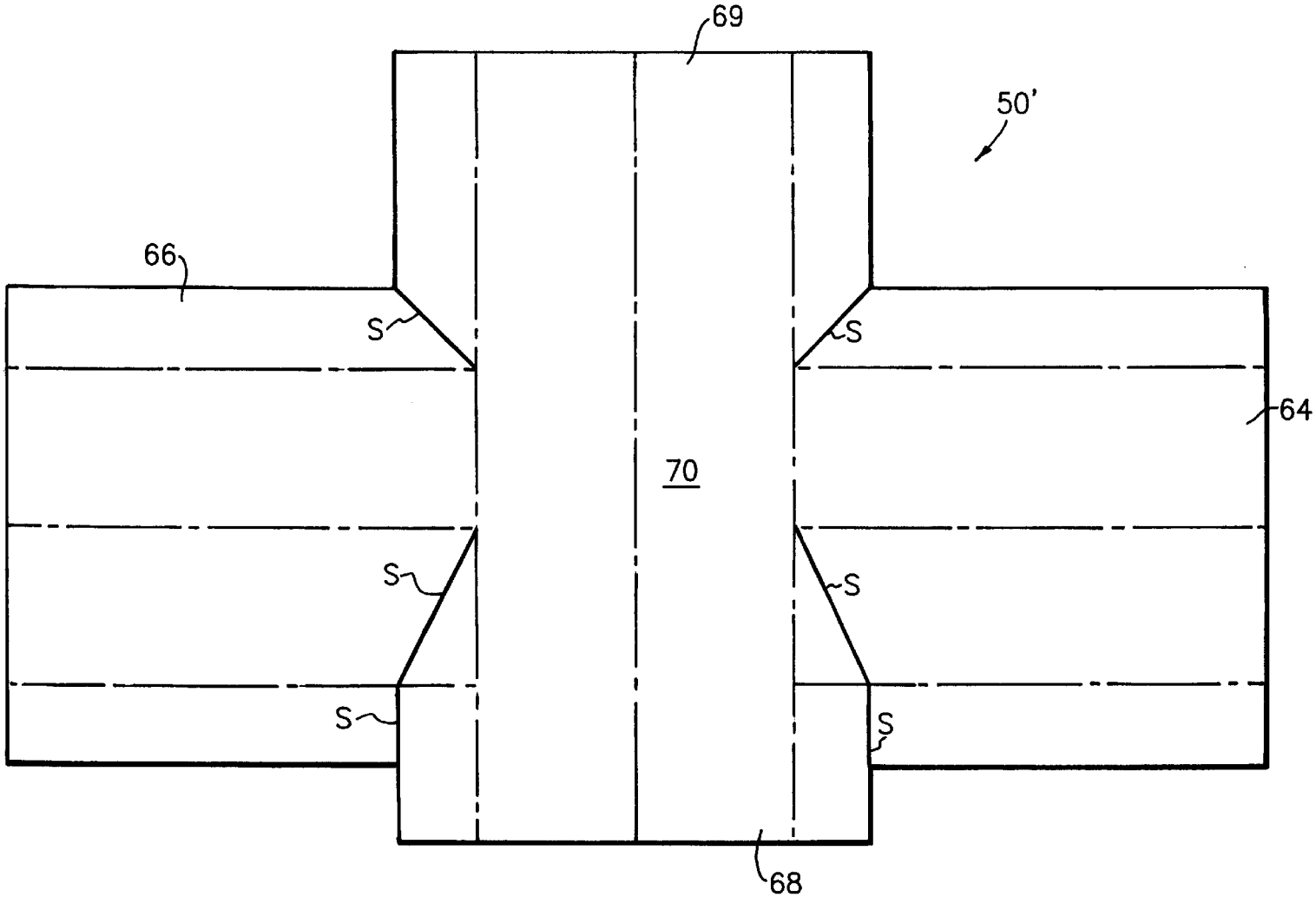
FIG. 2A is a top plan view of a flat sheet metal blank used to manufacture the connector shown in FIG. 2.

Referring now to FIG. 2 an alternate embodiment of the connector will be described. In this embodiment the connector 50 generally comprises two sections 52, 54 generally crossing each other, each having an elongate conductor or bar receiving area 56, 58, entrances 60, 62 on a same side into the receiving areas, and one section 52 being interposed between two portions 64, 66 of the other section 54. In this embodiment the first section 52 has general square cross-sectional shapes at two end portions 68, 69 (with one open corner to form parts of the entrance 60) and a center portion 70 with a general angled roof cross-section shape. The portions 64, 66 of the second section 54 also have a general square cross-sectional shape with one open corner to form parts of the entrance 62. With this embodiment the connector 50 is preferably directly crimped to both bars A, B. More specifically, the two portions 64, 66 are both crimped to the second bar B and the two portions 68, 69 are both crimped to the first bar A. However, in an alternate method only one of the portions 64 or 66 need to be compressed onto the second bar B and/or only one of the portions 68 or 69 need be compressed onto the first bar A. FIG. 2A shows a flat sheet metal blank 50' which is used to form the connector 50 shown in FIG. 2. The blank 50' is cut at locations S. This forms locations 64', 66', 68', 69', 70' which can then be stamped or bent at the dashed lines to form the portions 64, 66, 68, 69, 70.

Figure 3:
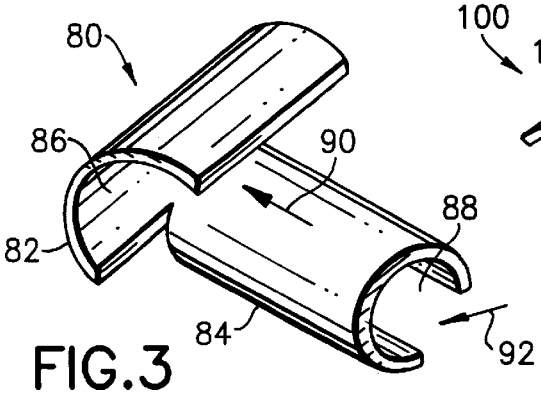
FIG. 3 is a perspective view of another alternate embodiment of the present invention.
Figure 4:
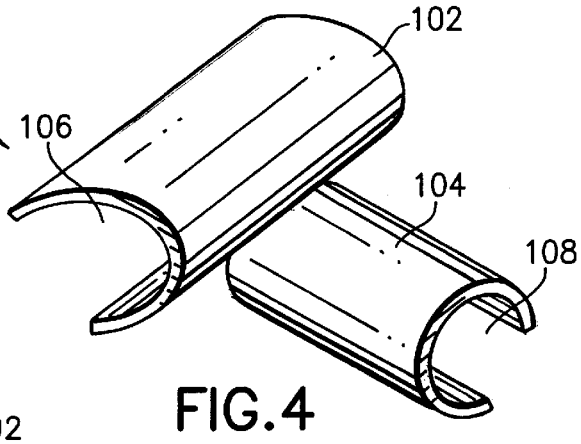
FIG. 4 is a perspective view of another alternate embodiment of the present invention.

Referring now to FIG. 3, another alternate embodiment is shown. In this embodiment the connector 80 is preferably comprised of a one-piece formed sheet metal member with a first section 82 and an integral second section 84. In this embodiment the connector has a general "T" shaped profile. However, any suitable profile could be provided. The first section 82 has a general C-shaped cross-section forming a first receiving area 86. The second section 84 has a general C-shaped cross-section forming a second receiving area 88. The first section 82 extends from an end of the second section 84. The first section 82 is generally perpendicular to the second section 84. The two receiving areas 86, 88 are generally perpendicular to each other, but spaced form each other with a portion of the sheet metal member separating the two areas 86, 88. The entrance 90 into the first section 82 is separate and spaced from the entrance 92 into the second section 84. The two entrances 90, 92 are also on different sides of the connector 80. FIG. 4 illustrates another alternate embodiment similar to FIG. 3, but wherein the two receiving areas 106, 108 formed by the two sections 102, 104 slightly intersect. The first and second bars A, B would contact each other with the use of this embodiment.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector for connecting first and second conductive crossing bars together comprising:

a first elongated enclosure for at least partially enclosing the first bar; and a second elongated enclosure intersecting said first elongated enclosure for at least partially enclosing the second bar wherein the first and second enclosures are comprised of a single sheet metal member, wherein the first elongated enclosure may be crimped on the first bar and the second elongated enclosure may be separately crimped on the second bar, and wherein an entrance for the first bar into the first enclosure passes through a portion of an entrance for the second bar into the second enclosure.

2. An electrical connector as in claim 1 wherein an entrance for the first bar into the first enclosure is on a same side of the connector as an entrance for the second bar into the second enclosure.

3. An electrical connector as in claim 1 wherein the first and second enclosures are generally angled relative to each other.

4. An electrical connector as in claim 1 wherein the connector comprises a general "X" shaped profile.

5. An electrical connector for connecting first and second conductive crossing bars together comprising:

a first elongated enclosure for at least partially enclosing the first bar; and a second elongated enclosure intersecting said first elongated enclosure for at least partially enclosing the second bar;

wherein the first and second enclosures are comprised of a single sheet metal member, wherein the first elongated enclosure may be crimped on the first bar and the second elongated enclosure may be separately crimped on the second bar, wherein the connector comprises a general "T" shaped profile, and wherein a portion of the sheet metal member separates bar receiving areas formed by the first and second enclosures from each other.

6. An electrical connector comprising:

a first section having a first receiving area which is sized and shaped to receive a portion of a first elongate bar therein; and a second section having a second receiving area which is sized and shaped to receive a portion of a second elongate bar therein, wherein the first and second sections are comprised of a single sheet metal member, wherein the first and second receiving areas are angled relative to each other, wherein the receiving areas are connected to each other at an intersection of the receiving areas such that the first and second bars contact each other when located in the receiving areas, and wherein an entrance for the portion of the first bar into the first section is on a same side of the connector as an entrance for the portion of the second bar into the second section.

7. An electrical connector as in claim 6 wherein the first and second sections each have a general elongate shape.

8. An electrical connector as in claim 6 wherein the first and second sections form a general "X" shaped profile.

9. An electrical connector as in claim 6 wherein the first and second sections form a general "T" shaped profile.

10. An electrical connector as in claim 6 wherein an entrance for the first bar into the first receiving area passes through a portion of an entrance for the second bar into the second receiving area.

11. An electrical connector as in claim 6 wherein each section comprises two spaced and separate respective compression areas.

12. A method of connecting two bars with an electrical connector comprising steps of:

providing the electrical connector with two bar receiving areas located at angles relative to each other, the connector comprising a formed sheet metal member, the connector having a first section and a second section which are sized and shaped to connect to the two bars at an overlapping X-shaped crossing area of the two bars;

locating the electrical connector on the two bars, the two bars being angled relative to each other; and compressing the electrical connector onto the bars by compressing the first section of the connector onto a first one of the bars and subsequently separately compressing the second separate section of the connector onto a second one of the bar.

* * * * *